United States Patent [19]

Sapkus et al.

[11] 3,992,807

[45] Nov. 23, 1976

[54] GROWTH-SIMULATING FIGURE TOY

[75] Inventors: Jurgis Sapkus, Manhattan Beach; J. Stephen Lewis, Pacific Palasades, both of Calif.

[73] Assignee: Mattel, Inc., Hawthorne, Calif.

[22] Filed: Mar. 17, 1975

[21] Appl. No.: 558,764

[52] U.S. Cl. ..... 46/119; 46/135 R

[51] Int. Cl.[2] ..... A63H 11/00

[58] Field of Search ..... 46/119, 120, 135 R, 46/161, 162; 223/68

[56] References Cited

UNITED STATES PATENTS

| | | | |
|---|---|---|---|
| 1,081,313 | 12/1913 | Satin et al. | 223/68 |
| 1,084,235 | 1/1914 | Selubsky | 223/68 |
| 1,102,711 | 7/1914 | Bailey | 223/68 |
| 1,136,148 | 4/1915 | Levin | 223/68 |
| 1,153,633 | 9/1915 | Levin | 223/68 |
| 2,273,743 | 2/1942 | Weinstein | 223/68 |
| 2,449,715 | 9/1948 | Puddicombe | 46/161 |
| 2,564,813 | 8/1951 | Moyers | 46/119 |
| 2,669,063 | 2/1954 | Lang | 46/119 |
| 2,741,870 | 4/1956 | Lang | 46/119 |
| 2,789,393 | 4/1957 | Cooke | 46/119 |
| 3,141,261 | 7/1964 | Mirando | 46/119 |
| 3,731,426 | 5/1973 | Lewis et al. | 46/119 |
| 3,812,613 | 5/1974 | Glass et al. | 46/119 |

*Primary Examiner*—Russell R. Kinsey
*Assistant Examiner*—Robert F. Cutting
*Attorney, Agent, or Firm*—Robert W. Mulcahy; Stephen L. King; Max E. Shirk

[57] ABSTRACT

Lower torso member includes a waist member having a lower portion of a first girth and an upper portion of a second, lesser girth so that pliable, rubber-like upper torso waist member may be slid from lower portion of lower torso waist member where it simulates waist of pudgy pre-teenager to upper portion of lower torso waist member where it simulates trim waist of a teenager while simulated breasts are simultaneously pressed outwardly against upper torso member causing bulging of the rubber-like material to form a simulated bustline.

6 Claims, 11 Drawing Figures

FIG. 3
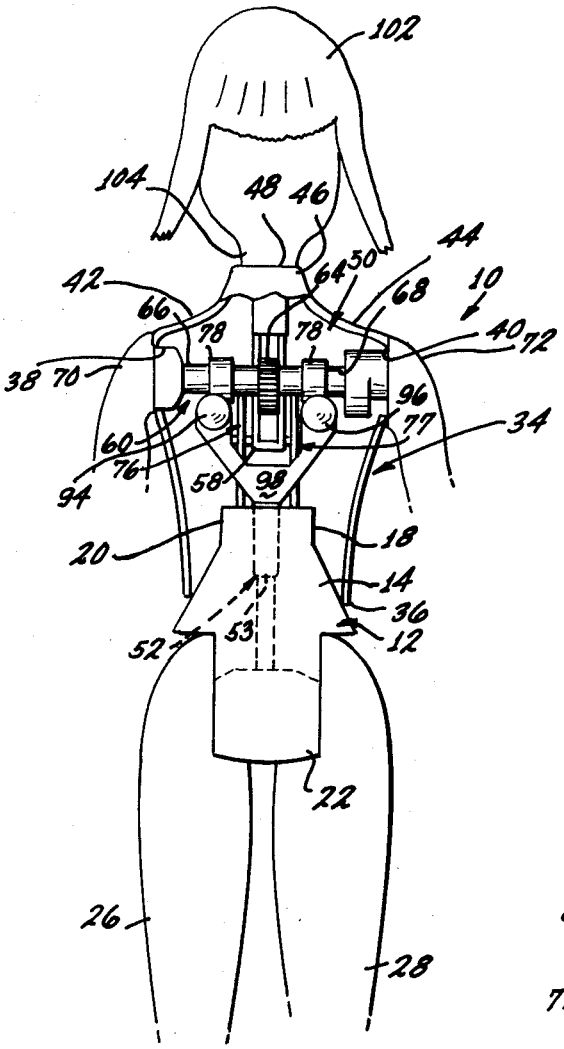
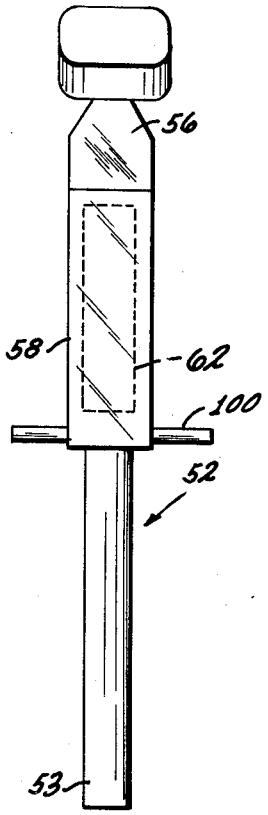
FIG. 8
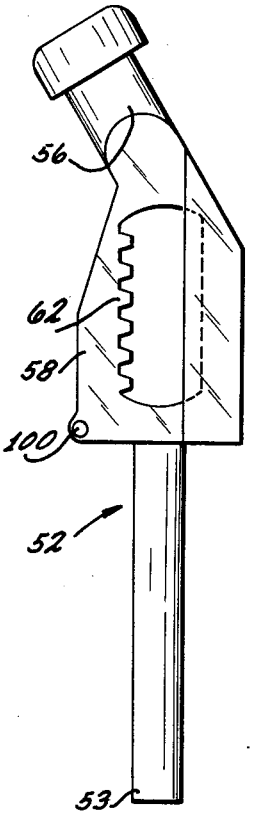
FIG. 9
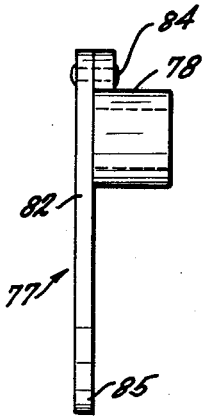
FIG. 10
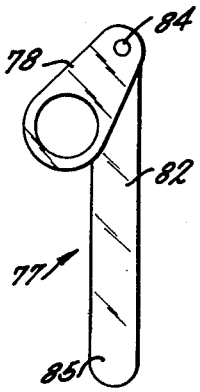
FIG. 11

GROWTH-SIMULATING FIGURE TOY

BACKGROUND OF THE INVENTION

The background of the invention will be set forth in two parts.

1. Field of the Invention

The present invention pertains generally to the field of so-called "growing" figure toys and more particularly to a new and useful growth-simulating figure toy which may be manipulated to simulate growth from a pre-teenage female to a teenage female.

2. Description of the Prior Art

The prior art known to applicant is listed by way of illustration, but not of limitation, in separate communications to the U.S. Patent Office.

Among this prior art are U.S. Pats. Nos. 2,741,870 and 3,731,426 owned by the assignee of the instant application.

U.S. Pat. No. 2,741,870 discloses a growing figure toy including a one-piece expansible and contractible covering. The figure toy contains a mechanism operative to expand the figure toy from a normal condition in both longitudinal and transverse directions for simulating animate growth. The mechanism is contractible for restoring the figure toy to normal position after an expanding operation.

U.S. Pat. No. 3,731,426 discloses a shape-changing figure toy which includes a shape-changing member normally disposed beneath a flexible covering material in a non-material bulging position. Means are connected to the shape-changing member for swinging it outwardly into a material-bulging position so that the shape of the figure toy is changed in a selected area.

OBJECTS AND SUMMARY OF THE INVENTION

It is a primary object of the present invention to provide a new and useful growth-simulating figure toy exemplifying improvements over prior art figure toys of the types disclosed in U.S. Pat. Nos. 2,741,870 and 3,731,426.

It is another object of the present invention to provide a new and useful growth-simulating figure toy which simulates the growth of a female from a pre-teenager to a teenager.

According to the present invention, a growth-simulating figure toy is provided and includes a lower torso member including a waist member having a lower portion of a first predetermined girth and an upper portion of a second predetermined girth less than the first predetermined girth.

A pliable, rubber-like upper torso member has a waist member slidably mounted on the lower torso waist member with the upper torso waist member conforming to the shape and girth of the lower torso waist member regardless of the location of the upper torso waist member with respect to the upper and lower portions of the lower torso waist member so that the upper torso waist member will simulate the pudgy waist of a pre-teenager when the upper torso waist member is in position on the lower portion of the lower torso waist member and will simulate the trim waist of a teenager when the upper torso waist member is in position on the upper portion of the lower torso waist member.

A new and useful connecting means is connected to the upper torso member for moving the upper torso waist member from one position to another position on the lower torso waist member.

The connecting means includes an actuator bar having a lower end slidably mounted in the lower torso member, an upper end connected to the neck of the upper torso member and an intermediate portion lying in a transverse plane passing through the shoulder openings in the upper torso member. The connecting means also includes a crankshaft means connected to the intermediate portion of the actuator bar for raising and lowering the actuator bar when the crankshaft means is rotated. The ends of the crankshaft means extend through the shoulder openings in the upper torso member and one arm of the figure toy is connected to one end of the crankshaft means for serving as a lever means to impart rotation to the crankshaft means.

Additionally, an overthrow crank means is connected to the crankshaft means and to the lower torso member for raising and lowering the shoulder openings when the actuator bar is raised and lowered.

The figure toy also includes a pair of simulated breasts which are swingably mounted in the upper torso member adjacent camming means movably mounted in the upper torso member in operative association with the simulated breasts for swinging them into bulging engagement with the upper torso member when the actuator bar is raised.

The features of the present invention which are believed to be novel are set forth with particularity in the appended claims. The present invention, both as to its organization and manner of use, together with further objects and advantages thereof, may best be understood by reference to the following description, taken in connection with the accompanying drawings in which like reference characters refer to like elements in the several views.

BRIEF DESCRIPTION OF THE DRAWINGS

FIG. 3 is a view similar to FIG. 1, but showing the mechanism after it has been manipulated to simulate growth;

FIG. 8 is a front elevational view of an actuator bar used in the mechanism of FIG. 1;

FIG. 9 is a side elevational view of the actuator bar of FIG. 8;

FIG. 10 is a front elevational view of a crank assembly shown on the mechanism in FIG. 1; and FIG. 11 is a side elevational view of the crank assembly of FIG. 10.

DESCRIPTION OF THE PREFERRED EMBODIMENT

Figure 1:
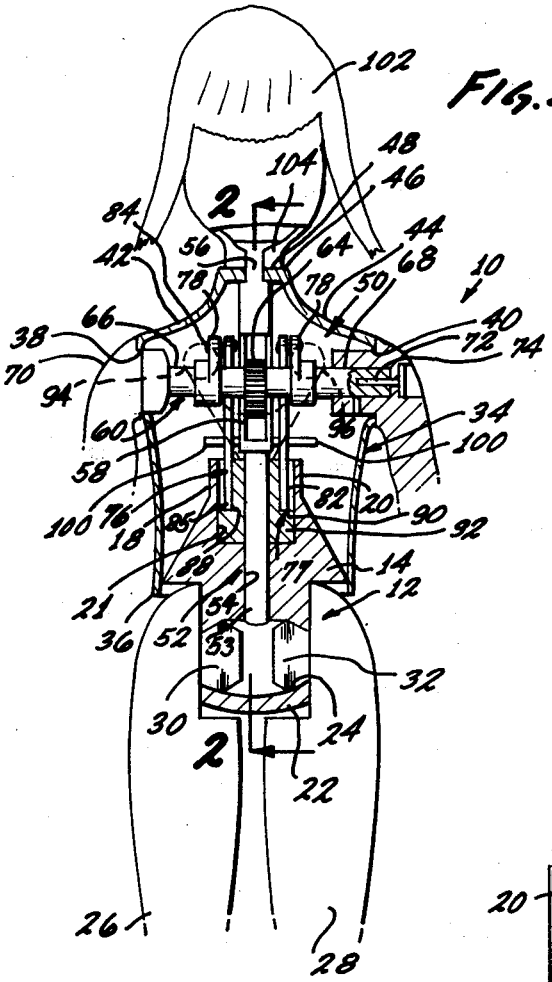
FIG. 1 is a front elevational view, with parts broken away to show internal construction, of a growth-simulating toy of the present invention showing the relative position of the toy mechanism before it has been manipulated to simulate growth.
Figure 2:
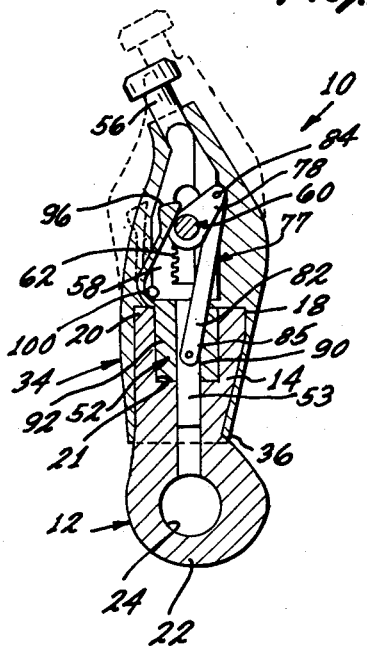
FIG. 2 is a partial, cross-sectional view taken along line 2—2 of FIG. 1.
Figure 4:
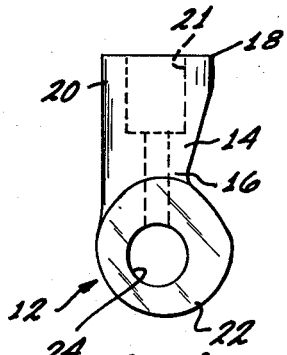
FIG. 4 is a side elevational view of the lower torso member of the figure toy of FIG. 1.
Figure 5:
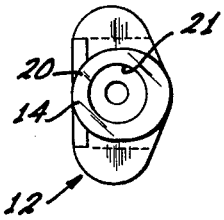
FIG. 5 is a plan view of the lower torso member of FIG. 4.
Figure 6:
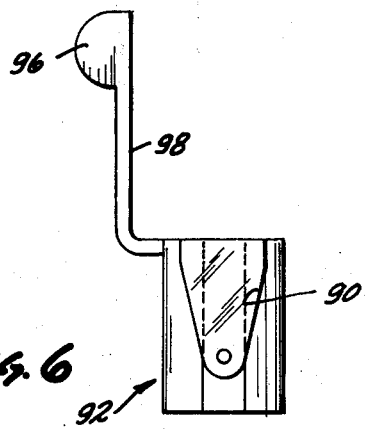
FIG. 6 is an elevational view of a breast-simulating member of FIG. 2.
Figure 7:
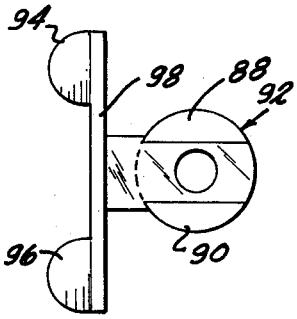
FIG. 7 is a plan view of the breast-simulating member of FIG. 6.

Referring again to the drawings, and more particularly to FIGS. 1 and 2, a growth-simulating figure toy constituting a presently preferred embodiment of the invention, generally designated 10, includes a lower torso member 12 made of a fairly rigid plastic material and including a waist member 14 having a lower portion 16 of a first predetermined girth and an upper portion 18 of a second predetermined girth less than said first predetermined girth. Lower torso member 12 also includes an upper end 20 provided with a counterbore 12 and a lower end 22 provided with a transverse bore 24.

Figure toy 10 also includes a pair of legs 26, 28 rotatably connected to the lower end 22 of lower torso member 12 by bosses 30, 32 respectively, engaged in transverse bore 24.

Figure toy 10 also includes a pliable, rubber-like upper torso member 34 having a waist member 36 slidably mounted on lower torso waist member 14 with the upper torso waist member 36 conforming to the shape and girth of the lower torso waist member 14 regardless of the location of the upper torso waist member 36 with respect to the upper and lower portions 16, 18 of the lower torso waist member 14 so that the upper torso waist member 36 will simulate the pudgy waist of a pre-teenager when the upper torso waist member 36 is in position on the lower portion 16 of the lower torso waist member 14 and will simulate the trim waist of a teenager when the upper torso waist member 36 is in position on the upper portion 18 of the lower torso waist member 14. The upper torso member 34 also includes a pair of shoulder openings 38, 40 from which shoulders 42, 44, respectively, slope upwardly to a neck 46 having a top wall 48.

Figure toy 10 also includes a connecting means 50 which is connected to the upper torso member 34 for moving the upper torso waist member 36 from one position to another position on the lower torso waist member 14. Connecting means 50 comprises an actuator bar 52, having a lower end 53 slidably mounted in a bore 54 provided in lower torso member 12, an upper end 56 forming a neck plug which is connected to top wall 48 on neck 46 and an intermediate portion 58 lying in a transverse plane passing through shoulder openings 42, 44; a crankshaft means 60 connected to a rack 62 on intermediate portion 58 of actuator bar 52 by a pinion 64 for raising and lowering actuator bar 52 when crankshaft means 60 is rotated by applying a force to one of its ends 66, 68 extending through shoulder openings 42, 44, respectively; and a suitable lever means, such as one of the doll arms 70, 72, connected to one end 66, 68 of crankshaft means 60 for imparting the rotating force. As shown herein for purposes of illustration, but not of limitation, the arm 72 is connected to end 68 by a key 74. Reference may be had to FIGS. 8 and 9 for a separate showing of actuator bar 52.

Connecting means 50 may also include suitable overthrow crank means connecting the crankshaft means to the lower torso member for raising and lowering the shoulder of figure toy 10 when actuator bar 52 is raised and lowered. As may best be seen in FIGS. 1, 2, 10 and 11, this overthrow crank means may comprise a pair of overthrow cranks 76, 77, each having a crank arm 78 keyed to crankshaft 60 by a pin 80 and a link 82 connected to a crank arm 78 by a pin 84. Each link 82 includes a lower end 85 seated in an associated one of the pockets 88, 90 provided in a collar 92 (FIGS. 1, 2, 6 and 7) frictionally engaged in counterbore 21 in lower torso member 12.

Figure toy 10 may also include a pair of simulated breasts 94, 96 which may be swingably mounted in upper torso member 34 by a yoke 98 formed integrally therewith and with collar 92. Additionally, a suitable camming means may be movably mounted in upper torso member 34 in operative association with simulated breasts 94, 96 for swinging them into bulging engagement with the upper torso member 34 when actuator bar 52 is raised. This may be accomplished by a transverse rod 100 (FIGS. 1, 2, 8 and 9) carried by the intermediate portion 58 of actuator bar 52 and located behind yoke 98 in sliding engagement therewith for pushing breasts 94, 96 to the broken line position shown for the breast 94 in FIG. 2 when actuator bar 52 is raised.

Figure toy 10 also includes a head 102 having a neck portion 104 engaged on the neck plug formed by end 56 of actuator rod 52.

In use, it may be assumed that the parts have the relative positions shown in FIG. 1. A child-user may then simulate growth in figure toy 10 by rotating arm 72 clockwise (as viewed in FIG. 2) so that pinion 64 will drive rack 62 upwardly while crank arms 78 and links 82 simultaneously lift crankshaft 60. This moves upper torso waist member 36 from the position shown in FIG. 1, where waist member 36 conforms to the enlarged portion 16 of waist member 14 for simulating a pudgy pre-teenager, to the position shown in FIG. 3 where waist member 36 conforms to the reduced portion 18 of waist member 14 for simulating the trim waist of a teenager. Simultaneously, actuator bar 52 elongates neck 46 and transverse rod 100 moves breast 94, 96 into bulging relationship with upper torso member 34, as shown in FIG. 2 in broken lines for the breast 94.

Arm 72 may then be rotated counterclockwise to return figure toy 10 to its FIG. 1 position.

While the particular growth-simulating figure toy herein shown and described in detail is fully capable of attaining the objects and providing the advantages hereinbefore stated, it is to be understood that it is merely illustrative of the presently preferred embodiment of the invention and that no limitations are intended to the details of construction or design herein shown other than as defined in the appended claims which form a part of this disclosure.

Whenever the term "means" is employed in these claims, this term is to be interpreted as defining the corresponding structure illustrated and described in this specification or the equivalent of the same.

What is claimed is:

1. A growth-simulating figure toy, comprising:

a lower torso member including a waist member having a lower portion of a first predetermined girth and an upper portion of a second predetermined girth less than said first predetermined girth;

a pliable rubber-like upper torso member having a waist member slidably mounted on said lower torso waist member, said upper torso waist member conforming to the shape and girth of said lower torso waist member regardless of the location of said upper torso waist member with respect to said upper and lower portions of said lower torso waist member, whereby said upper torso waist member will simulate the pudgy waist of a pre-teenager when said upper torso waist member is in position on said lower portion of said lower torso waist member and will simulate the trim waist of a teenager when said upper torso waist member is in position on said upper portion of said lower torso waist member; and means connected to said upper torso member for moving said upper torso waist member from one position to another position on said lower torso waist member.

2. A growth-simulating figure toy, comprising:

1. a lower torso member including a waist member having a lower portion of a first predetermined girth and an upper portion of a second predetermined girth less than said first predetermined girth;
2. a pliable rubber-like upper torso member having a waist member slidably mounted on said lower torso waist member, said upper torso waist member conforming to the shape and girth of said lower torso waist member regardless of the location of said upper torso waist member with respect to said upper and lower portions of said lower torso waist member, whereby said upper torso waist member will simulate the pudgy waist of a pre-teenager when said upper torso waist member is in position of said lower portion of said lower torso waist member and will simulate the trim waist of a teenager when said upper torso waist member is in position on said upper portion of said lower torso waist member, said upper torso member including a neck portion and a pair of shoulder openings; and
3. means connected to said upper torso member for moving said upper torso waist member from one position to another position on said lower torso waist member, said means connected to said upper torso member comprising:
   A. an actuator bar having a lower end slidably mounted in said lower torso member, an upper end connected to said upper torso neck portion and an intermediate portion lying in a transverse plane passing through said shoulder openings;
   B. crankshaft means connected to said intermediate portion of said actuator bar for raising and lowering said actuator bar when said crankshaft means is rotated, said crankshaft means having an end extending through one of said shoulder openings; and
   C. lever means connected to said one end of said crankshaft means for imparting rotation thereto.

3. A growth-simulating figure toy as stated in claim 2 wherein said means connected to said upper torso member includes overthrow crank means connecting said crankshaft means to said lower torso member for raising and lowering said shoulder openings when said actuator bar is raised and lowered.

4. A growth-simulating figure toy as stated in claim 3 including:

a pair of simulated breasts swingably mounted in said upper torso member; and cam means movably mounted in said upper torso member in operative association with said simulated breasts for swinging said simulated breasts into bulging engagement with said upper torso member when said actuator bar is raised.

5. A growth-simulating figure toy, comprising:

1. a lower torso member including a waist member having a lower portion of a first predetermined girth and an upper portion of a second predetermined girth less than said first predetermined girth;
2. a pliable rubber-like upper torso member having a waist member slidably mounted on said lower torso waist member, said upper torso waist member conforming to the shape and girth of said lower torso waist member regardless of the location of said upper torso waist member with respect to said upper and lower portions of said lower torso waist member, whereby said upper torso waist member will simulate the pudgy waist of a pre-teenager when said upper torso waist member is in position on said lower portion of said lower torso waist member and will simulate the trim waist of a teenager when said upper torso waist member is in position on said upper portion of said lower torso waist member; and
3. means connected to said upper torso member for moving said upper torso waist member from one position to another position on said lower torso waist member, said means connected to said upper torso member comprising:
   A. an actuator bar having a lower end slidably mounted in said lower torso member, an upper end connected to said upper torso neck portion and an intermediate portion lying in a transverse plane passing through said shoulder openings;
   B. crankshaft means connected to said intermediate portion of said actuator bar for raising and lowering said actuator bar when said crankshaft means is rotated, said crankshaft means having an end extending through one of said shoulder openings;
   C. lever means connected to said one end of said crankshaft means for imparting rotation thereto;
   D. overthrow crank means connecting said crankshaft means to said lower torso member for raising and lowering said shoulder openings when said actuator bar is raised and lowered;
   E. a pair of simulated breasts swingably mounted in said upper torso member; and
   F. cam means movably mounted in said upper torso member in operative association with said simulated breasts for swinging said simulated breasts into bulging engagement with said upper torso member when said actuator bar is raised.

6. A growth-simulating figure toy, comprising:

a rigid lower torso member having an inwardly-tapered upper end forming a waist portion provided with a counterbore;

a collar seated in said counterbore, said collar having a substantially vertical, throughgoing bore and an upper end;

a pair of simulated breasts swingably connected to said upper end of said collar;

an actuating bar slidably mounted in said throughgoing bore in said collar, said actuating bar having a substantially vertical major axis, an upper end, an intermediate portion and a lower end;

rack means provided on said intermediate portion of said actuating bar;

a crankshaft rotatably mounted on said intermediate portion of said actuating bar normal to the major axis thereof, said crankshaft having outbored ends;

a figure toy arm having a shoulder portion keyed to one of said outbored ends of said crankshaft for imparting rotation thereto;

a pinion keyed to said crankshaft in driving engagement with said rack;

at least one crank keyed to said crankshaft;

link means connecting said crank to said collar;

a pliable, rubber-like upper torso member having a neck portion connected to the upper end of said actuating bar, said upper torso member also having shoulder areas and a waist area, said waist area being stretchable for conforming to the shape of the waist portion of said lower torso member; and cam means affixed to said intermediate portion of said actuating bar for camming said simulated breasts outwardly against said pliable upper torso portion when said actuating bar is moved upwardly in said figure toy.

* * * * *